US007477006B2

(12) United States Patent
Fukuzawa et al.

(10) Patent No.: US 7,477,006 B2
(45) Date of Patent: Jan. 13, 2009

(54) SPARK PLUG FOR INTERNAL COMBUSTION ENGINE AND METHOD OF MANUFACTURING THE SAME

(75) Inventors: Reimon Fukuzawa, Ama-gun (JP); Jiro Kyuno, Kiyosu (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 11/926,766

(22) Filed: Oct. 29, 2007

(65) Prior Publication Data

US 2008/0098974 A1 May 1, 2008

(30) Foreign Application Priority Data

Oct. 30, 2006 (JP) ..... 2006-293425
Sep. 25, 2007 (JP) ..... 2007-246490

(51) Int. Cl.
*H01T 13/08* (2006.01)

(52) U.S. Cl. ..... 313/118; 277/591; 277/598; 277/644; 123/169 R; 445/7

(58) Field of Classification Search ..... 313/118; 123/169 B; 445/7; 277/591, 598, 644
See application file for complete search history.

(56) References Cited

U.S. PATENT DOCUMENTS 2,921,109 A * 1/1960 Novak ..... 123/169 R
2,941,105 A 6/1960 Rickenbach
3,029,084 A * 4/1962 Gobb ..... 277/598
3,099,456 A * 7/1963 Hopp ..... 277/598
3,299,504 A * 1/1967 Hopp ..... 29/511
3,332,141 A * 7/1967 Hopp ..... 29/520
3,719,850 A * 3/1973 Schafer ..... 313/118
3,948,532 A * 4/1976 Hopp ..... 277/598
4,168,839 A * 9/1979 Hopp et al. ..... 29/270
4,241,491 A * 12/1980 Hopp ..... 29/511
2007/0114901 A1* 5/2007 Nagasawa et al. ..... 313/141

FOREIGN PATENT DOCUMENTS

EP 1 508 947 A1 2/2005
JP 61-57830 A 4/1986
JP 6-283249 A 10/1994
JP 2001-187966 A 7/2001

OTHER PUBLICATIONS

Extended European Search Report dated Feb. 8, 2008.

* cited by examiner

*Primary Examiner*—Erick Solis
(74) *Attorney, Agent, or Firm*—Sughrue Mion, PLLC

(57) ABSTRACT

A spark plug for an internal combustion engine includes: a cylindrical insulator as defined herein; a center electrode as defined herein; a cylindrical metal shell as defined herein; and a ground electrode as defined herein, an annular gasket receiving portion projecting radially outward being provided on a rear end side of the externally threaded portion of the metal shell, and a metallic gasket capable of abutting against the gasket receiving portion being provided on the outer periphery of the metal shell, wherein the gasket has a solid annular shape, an inside diameter of the gasket is smaller than an outside diameter of the externally threaded portion, and a groove portion whose depth coincides with the direction of the axis is provided over an entire circumference of the gasket.

5 Claims, 5 Drawing Sheets

SPARK PLUG FOR INTERNAL COMBUSTION ENGINE AND METHOD OF MANUFACTURING THE SAME

FIELD OF THE INVENTION

The present invention relates to a spark plug for use in an internal combustion engine, and more particularly to a spark plug having a gasket provided on an outer periphery of a metal shell and a method of manufacturing the same.

BACKGROUND OF THE INVENTION

A general spark plug which is used for igniting an internal combustion engine such as an automotive gasoline engine is comprised of a center electrode, an insulator provided on its outer periphery, a cylindrical metal shell provided on the outer periphery of the insulator, and a ground electrode having a proximal end portion joined to a leading end portion of the metal shell. An externally threaded portion is formed on the outer peripheral surface of the metal shell, and an annular gasket receiving portion projecting in a radially outward direction is formed on a rear end side of the externally threaded portion. Meanwhile, a threaded hole having an internally threaded portion is formed in a cylinder head of the engine. As the externally threaded portion is threadedly secured in that threaded hole, the spark plug is mounted to the engine. Here, the portion on the rear end side of the externally threaded portion of the metal shell adjacent to the gasket receiving portion is a portion called a thread neck, and an annular gasket is provided on that thread neck. As the externally threaded portion is threadedly secured in the threaded hole, i.e., is screwed in, the gasket is compressed between the gasket receiving portion and a peripheral edge portion of the opening of the threaded hole so as to be crushed, thereby sealing the gap between the threaded hole and the gasket receiving portion.

As conventional gaskets, commonplace are those which are obtained by subjecting ring-shaped metallic thin plate members to bending in the radial direction by using a special die unit so as to be formed into predetermined shapes (e.g., so-to-speak hollow shapes having substantially S-shaped cross sections or the like) (for example, refer to JP-A-2001-187966 and the like). After being fitted over the aforementioned thread neck, such a gasket is subjected to predetermined cut bending to thereby form a plurality of (e.g., three) pawl portions in such a manner as to project radially inward. Thus, since the pawl portions are formed after the fitting of the gasket, the gasket is prevented from riding over the thread of the externally threaded portion, thereby preventing the gasket from coming off.

Incidentally, with such as engines of a stratified charge combustion type in recent years, there are cases where if variations occur in an ignition point (i.e., the position within a combustion chamber of a spark discharge gap formed between the center electrode and the ground electrode), an intended form of combustion fails to be obtained. Therefore, in such an engine, it can be said that the angular position (orientation) of the ground electrode is, of course, important, but the position in the vertical direction (axial direction of the plug) of the ignition point in the mounted state of the spark plug is extremely important in ensuring a stable form of combustion.

However, in the case where the above-described gasket having the so-to-speak hollow shape is used, since the amount of crushing deformation at the time of threaded securing is relatively large, the variation of the amount of deformation also becomes large. For this reason, even in cases where the spark plug is mounted to the engine with a predetermined normal torque, the ignition point within the combustion chamber undesirably varies, so that it is apprehended that trouble can possibly occur in achieving stable combustion.

In contrast, it is also conceivable to use a so-to-speak solid gasket with a predetermined thickness and having an annular disk shape (e.g., refer to JP-UM-A-61-57830 and the like). By using such a gasket, the amount of crushing deformation at the time of threaded securing can be made relatively small, and it is possible to suppress the variation of the ignition point. In addition, with such a solid gasket as well, in the same way as described above, it is conceivable to attempt the prevention of coming off by forming a plurality of pawl portions in such a manner as to project radially outward by cut bending after the fitting of the gasket.

SUMMARY OF THE INVENTION

In the case of the gasket having a hollow shape with a substantially S-shaped cross section or the like as described above, even if the pawl portions are formed, the outer peripheral side located radially outwardly of the pawl portions has a predetermined height, and when the spark plug is installed in the engine and the gasket is crushed and deformed, a gap is not formed between a peripheral edge portion of the threaded hole of the engine and the gasket receiving portion. Therefore, no trouble occurs in the gas-tightness of the spark plug. However, in the case of the solid gasket with such as an annular disk shape, since the pawl portions are formed, there is a possibility of local recesses being formed at peripheral portions of the pawl portions. For this reason, it is apprehended that the gas leaks through the recesses, disadvantageously causing trouble in the gas-tightness.

In addition, as the plurality of pawl portions are projectingly formed, the pawl portions are caught at the thread, and a measure can be thereby provided for preventing the spark plug from coming off in the axial direction of the plug, but once the spark plug is fitted, the following problem can possibly occur. Namely, the pawl portions which are formed by cut bending are localized, and are likely to be crushed and deformed at the time of threaded securing, and it is envisioned that these pawl portions become relatively thin-walled after completion of the threaded securing. In this case, in a case where an attempt is made to remove the spark plug by loosening the thread, or after its removal, there is a possibility that an inner end of the pawl portion which became thin-walled may undesirably enter the trough of the externally threaded portion, and the gasket may relatively rotate along the trough and may undesirably come off finally from the spark plug. In addition, there is also a possibility of coming off during the mounting operation owing to the variation of the cut bending.

The invention has been devised in view of the above-described circumstances, and its object is to provide a spark plug which is provided with a gasket on the outer periphery of the metal shell, and which is capable of suppressing the variation of the ignition point and of achieving the prevention of the gasket from coming off while ensuring the gas-tightness, as well as a method of manufacturing the same.

Hereafter, a description will be given of the respective configurations which are suitable for overcoming the above-described problems under different paragraphs. It should be noted that operational effects and the like peculiar to the corresponding configurations will be additionally described, as required.

Configuration 1: The spark plug in this configuration comprises:

a cylindrical insulator having an axial hole penetrating in a direction of an axis;

a center electrode insertedly provided in the axial hole;

a cylindrical metal shell provided on an outer periphery of the insulator and having on its outer periphery an externally threaded portion for mounting; and a ground electrode provided on the metal shell such that a portion of the ground electrode opposes a leading end portion of the center electrode, the ground electrode forming a spark discharge gap between the same and the leading end portion of the center electrode, an annular gasket receiving portion projecting radially outward being formed on a rear end side of the externally threaded portion of the metal shell, and a metallic gasket capable of abutting against the gasket receiving portion being provided on the outer periphery of the metal shell, wherein the gasket has a solid annular shape, an inside diameter thereof is smaller than an outside diameter of the externally threaded portion, and a groove portion whose depth coincides with the direction of the axis is formed over an entire circumference of the gasket.

According to the configuration 1, as the externally threaded portion on the outer periphery of the metal shell of the spark plug is threadedly secured in a threaded hole formed in an internal combustion engine, i.e., is screwed in, the gasket is compressed in such a manner as to be crushed between the gasket receiving portion and a peripheral edge portion of the opening of the threaded hole, thereby sealing the gap between the threaded hole and the gasket receiving portion.

The gasket in the configuration 1 has a solid annular shape. For this reason, as compared with a gasket having a so-so-speak hollow shape such as a substantially S-shaped cross section or the like, it is possible to reduce the amount of crushing deformation at the time of threaded securing and suppress the variation of the amount of deformation as well. As a result, the variation of the ignition point in the installed state of the spark plug is difficult to occur, so that it is possible to ensure a stable form of combustion. In addition, since the inside diameter of the gasket is smaller than the outside diameter of the externally threaded portion, the gasket does not ride over the thread of the externally threaded portion. Consequently, it is possible to achieve the prevention of the gasket from coming off along the axial direction.

Furthermore, with the gasket in the configuration 1, (1) the gasket has a solid annular shape, and its inner end also has a substantially circular shape; (2) its inside diameter is smaller than the outside diameter of the externally threaded portion; and (3) the groove portion whose depth coincides with the axial direction is formed over the entire periphery. Therefore, it can be said that the gasket is provided on the thread neck of the metal shell as inside-diameter miniaturization work (so-to-speak annular cut bending) corresponding to the conventional cut bending is provided after the gasket is fitted past the externally threaded portion. Namely, it can be said that as the gasket preform is pressed by using a predetermined annular jig or the like, the groove portion is formed, and as the pressed wall portion juts out toward the inner peripheral side, the inside diameter of the gasket is made smaller than the outside diameter of the externally threaded portion. Accordingly, in the gasket in the configuration 1, unlike a gasket having a plurality of local pawl portions explained in the section on the conventional art, the gasket is deformed uniformly over its entire periphery, so that local recesses are not formed. For this reason, the situation in which the gas otherwise leaks through the local recesses does not occur, and therefore it is possible to prevent the defect of trouble undesirably occurring in the gas-tightness.

In addition, since the pawl portion is not localized, the crushing deformation is unlikely to occur at the time of threaded securing. For this reason, it is unlikely to occur for the inner peripheral portion of the gasket to become relatively thin-walled after completion of the threaded securing, and the situation in which the inner peripheral portion enters the trough of the externally threaded portion and the gasket relatively rotates can be made difficult to occur.

Configuration 2: In the spark plug in this configuration, in the above-described configuration 1, the gasket includes an inner peripheral side portion on an inner peripheral side of the groove portion and an outer peripheral side portion on an outer peripheral side of the groove portion, and a thickness of the outer peripheral side portion in the direction of the axis is greater than a thickness of the inner peripheral side portion in the direction of the axis.

According to the configuration 2, in the threadedly securing process of the spark plug, the outer peripheral side portion on the outer peripheral side of the groove portion receives a compressive stress more preferentially than the groove portion. Accordingly, the amount of crushing deformation of the gasket during threaded securing is mainly determined on the basis of that outer peripheral side portion. Here, since the outer peripheral side portion of the gasket has a solid shape, it is possible to minimize the variation of the thickness of the outer peripheral side portion in individual gaskets, so that the variation of the ignition point in the installed state of the spark plug can be suppressed relatively easily. Consequently, it is possible to ensure a more stable form of combustion. On the other hand, it can be said that the inner peripheral side portion on the inner peripheral side of the groove portion is difficult to be compressed during the threaded securing. For this reason, it is possible to prevent the tendency of the inner peripheral side portion of the gasket to become thin-walled and, hence, the trouble caused by the thin wall due to the crushing deformation during the threaded securing.

Configuration 3: In the spark plug in this configuration, in the above-described configuration 2, the groove portion is formed deeply in excess of a half of the thickness of the outer peripheral side portion in the direction of the axis, while the thickness of the inner peripheral side portion in the direction of the axis is formed with a large thickness in excess of a half of the thickness of the outer peripheral side portion in the direction of the axis.

According to the above-described configuration 3, in the case where the groove portion is formed as the gasket preform is pressed by using the predetermined annular jig or the like, the pressed wall portion is likely to jut out toward the inner peripheral side. Moreover, the thickness of the aforementioned inner peripheral side portion in the axial direction is relatively large. For these reasons, further prevention of coming off can be achieved.

Configuration 4: In the spark plug in this configuration, in any one of the above-described configurations 1 to 3, a wall surface on the inner peripheral side of the groove portion is formed as a tapered surface.

As described above, it can be said that as the gasket preform is pressed annularly by using the predetermined annular jig or the like, the groove portion is formed, and as the pressed wall portion juts out toward the inner peripheral side, the inside diameter of the gasket is made smaller than the outside diameter of the externally threaded portion. Here, if such a jig that the cross sectional shape of the groove portion to be formed would become a rectangular shape or the like is used, cases are envisioned in which the thickness of the inner peripheral side portion jutting out on the inner peripheral side becomes excessively small. By contrast, in the configuration 4, the groove portion is formed by using such a jig or the like that the wall surface on the inner peripheral side becomes a tapered surface. For this reason, the thickness of the inner peripheral side portion formed by being pressed and jutting out on the inner peripheral side does not become excessively small in accompaniment with the deformation of the groove portion, thereby making it possible to realize the miniaturization of the inside diameter of the gasket.

Configuration 5: In the spark plug in this configuration, in any one of the above-described configurations 1 to 4, if the thickness in the direction of the axis of an innermost peripheral side portion of the gasket is assumed to be t, a following formula (1) is satisfied.

$$t \geq \frac{\sqrt{3}}{2} \times \frac{P}{2H}(A + H - Dp) \times \frac{1}{\sin(60^\circ - \theta)} \quad (1)$$

where A is the inside diameter of the gasket;

P is a pitch of a thread;

Dp is an effective diameter of the thread;

H is a horizontal distance between an imaginary point at a trough of the thread and an imaginary point at a ridge of the thread; and θ is an angle (lead angle) formed by the axis and an inner end line of the gasket in an arbitrary cross section along the axis when it is assumed that an inner end of the gasket slides along the externally threaded portion.

As described above, in the case where the innermost peripheral portion of the gasket is relatively thin-walled, it is apprehended that that the inner peripheral side portion may undesirably enter the trough of the externally threaded portion, and that the gasket may relatively rotate along the trough. In this respect, according to the configuration 5, if the thickness in the axial direction of the innermost peripheral portion of the gasket is assumed to be t, since the thickness t is sufficiently large, the situation in which the inner peripheral side portion undesirably enters the trough of the externally threaded portion does not occur. Consequently, the disengagement of the gasket can be prevented more reliably.

In addition, the above-described spark plug can be manufactured as follows:

Configuration 6: The method of manufacturing the spark plug in this configuration comprises the steps of:

forming a gasket preform having an annular shape and having an inside diameter greater than the outside diameter of the externally threaded portion of the metal shell; and by using a working jig having on the outer peripheral side a protruding portion for forming the groove portion, which protrudes in a pressing direction, and having on an inner peripheral side of the protruding portion a receiving surface for receiving a portion on an inner peripheral side of a portion where the groove portion is formed, through a tapered surface which is tapered in the direction opposite to the pressing direction, forming the gasket in which an inside diameter of an inner peripheral side portion on an inner peripheral side of the groove portion is smaller than the outside diameter of the externally threaded portion, on the basis of the pressing of the gasket preform.

According to the configuration 6, the spark plug capable of exhibiting the above-described operational effects can be manufactured stably and efficiently without incurring such as the complexity of operation. In addition, it is possible to eliminate a factor hampering productivity in that the formed gasket bites into the working jig.

DESCRIPTION OF REFERENCE NUMERALS AND SIGNS

1: spark plug, 2: insulator, 3: metal shell, 4: axial hole, 5: center electrode, 15: externally threaded portion, 16*a*: gasket receiving portion, 17: thread neck, 18: gasket, 27: ground electrode, 33: spark discharge gap, 41: cylinder head, 42: threaded hole, 51: main body portion, 53: annular pawl portion, 54: annular groove portion, 55: tapered surface, C1: axis, PC: (working) jig, PC1: protruding portion, PC2: tapered surface, PC3: receiving surface

DETAILED DESCRIPTION OF THE INVENTION

Figure 1:
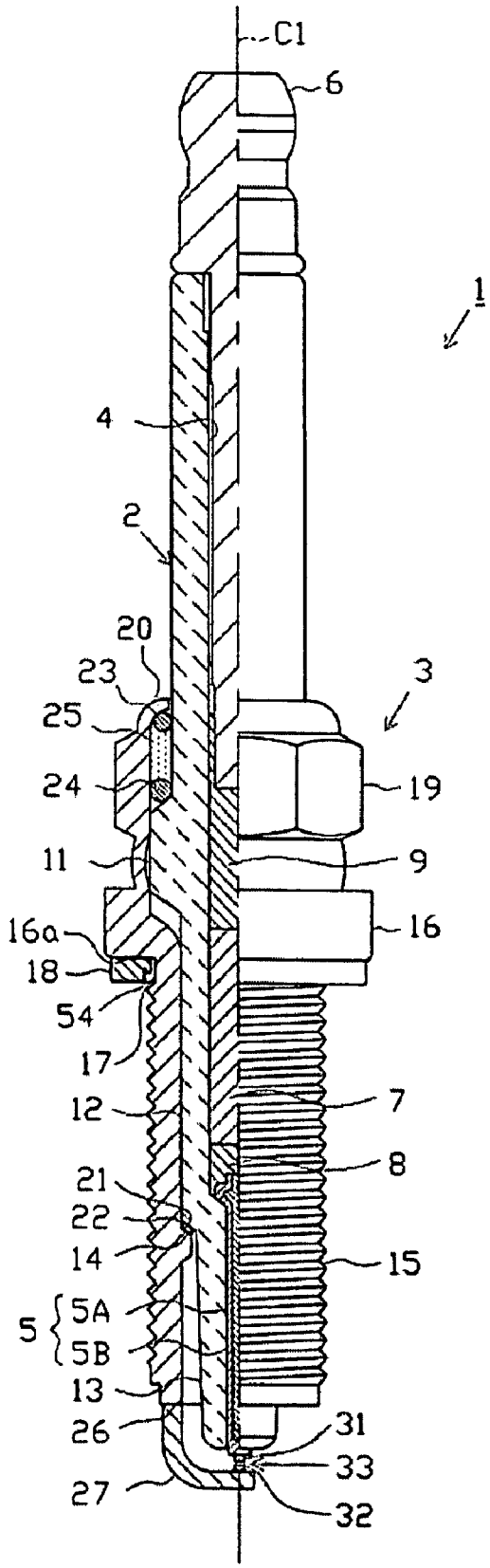
FIG. 1 is a fragmentary front elevational view illustrating the configuration of a spark plug in accordance with this embodiment.

Hereafter, a description will be given of an embodiment of the invention with reference to the drawings. FIG. 1 is a fragmentary front elevational view illustrating a spark plug 1. It should be noted that a description will be given by assuming that, in FIG. 1, the direction of an axis C1 of the spark plug 1 is a vertical direction in the drawing, and that the lower side of the drawing is a leading end side of the spark plug 1 and the upper side is a rear end side thereof.

The spark plug 1 is comprised of a cylindrical insulator 2, a cylindrical metal shell 3 for holding it, and the like.

An axial hole 4 is penetratingly formed in the insulator 2 along the axis C1. A center electrode 5 is inserted and fixed in a leading end portion side of the axial hole 4, and a terminal electrode 6 is inserted and fixed in a rear end portion side thereof. A resistor 7 is disposed between the center electrode 5 and the terminal electrode 6 inside the axial hole 4, and opposite end portions of this resistor 7 are electrically connected to the center electrode 5 and the terminal electrode 6 through glass seal layers 8 and 9, respectively.

The center electrode 5 is fixed so as to protrude from the leading end of the insulator 2, and the terminal electrode 6 is fixed so as to protrude from the rear end of the insulator 2. In addition, a noble metal tip 31 is joined to the leading end of the center electrode 5 by welding (which will be described later).

Meanwhile, as is generally known, the insulator 2 is formed by sintering alumina or the like, and includes in its outer configuration portion a flange-like large-diameter portion 11 formed in such a manner as to protrude radially outward in a substantially central portion in the direction of the axis C1; a middle trunk portion 12 formed forwardly of that large-diameter portion 11 and having a smaller diameter than the same; and a long leg portion 13 formed forwardly of that middle trunk portion 12 and having a smaller diameter than the same, the long leg portion 13 being exposed to the interior of the internal combustion engine. The leading end side of the insulator 2, including the large-diameter portion 11, the middle trunk portion 12, and the long leg portion 13, is accommodated within the metal shell 3 formed in a cylindrical shape. A stepped portion 14 is formed at a connecting portion between the long leg portion 13 and the middle trunk portion 12, and the insulator 2 is retained by the metal shell 3 at this stepped portion 14.

The metal shell 3 is formed of a metal such as low carbon steel into a cylindrical shape, and has on its outer peripheral surface an externally threaded portion 15 for installing the spark plug 1 in a cylinder head 41 (see FIG. 2) of the engine. A flange portion 16 protruding radially outward is formed on the rear end side of the externally threaded portion 15, and a leading end-side surface of the flange portion 16 serves as a gasket receiving portion 16*a*. A thread neck 17 where the thread is not formed is formed between the rear end and the gasket receiving portion 16*a* of the externally threaded portion 15, and a ring-shaped gasket 18 is fitted on this thread neck 17 (which will be described later). Further, on the rear end side of the metal shell 3, there are provided a tool engagement portion 19 with a hexagonal cross section for engaging with a tool, such as a wrench, at the time of installing the metal shell 3 in the aforementioned cylinder head 41, as well as a caulked portion 20 for holding the insulator 2 at the rear end portion.

In addition, a stepped portion 21 for retaining the insulator 2 is provided on the inner peripheral surface of the metal shell 3. The insulator 2 is inserted from the rear end side of the metal shell 3 toward the leading end side. In a state in which the stepped portion 14 of the insulator 2 is retained by the stepped portion 21 of the metal shell 3, an opening at the rear end side of the metal shell 3 is caulked radially inward, i.e., the aforementioned caulked portion 20 is formed, and the insulator 2 is thereby fixed. It should be noted that an annular plate packing 22 is interposed between respective stepped portions 14 and 21 of the insulator 2 and the metal shell 3. This ensures that the airtightness of the interior of a combustion chamber is maintained, and that a fuel-air mixture entering the gap between the long leg portion 13 of the insulator and the inner peripheral surface of the metal shell 3, which is exposed to the interior of the combustion chamber, does not leak to the outside.

Furthermore, to render the sealing by caulking more complete, on the rear end side of the metal shell 3, annular ring members 23 and 24 are interposed between the metal shell 3 and the insulator 2, and a powder of talc 25 is filled around the ring members 23 and 24. Namely, the metal shell 3 holds the insulator 2 by means of the plate packing 22, the ring members 23 and 24, and the talc 25.

In addition, a substantially L-shaped ground electrode 27 is joined to a leading end face 26 of the metal shell 3. Namely, the ground electrode 27 is disposed such that its proximal end portion is welded to the leading end face 26 of the metal shell 3, and its leading end side is bent to cause its side surface to oppose the leading end portion (noble metal tip 31) of the center electrode 5. A noble metal tip 32 is provided on that ground electrode 27 so as to oppose the noble metal tip 31. The gap between these noble metal tips 31 and 32 serves as a spark discharge gap 33.

The center electrode 5 is comprised of an inner layer 5A formed of copper or a copper alloy and an outer layer 5B formed of a nickel (Ni) alloy. Also, the ground electrode 27 is formed of an Ni alloy or the like.

The center electrode 5 has its leading end side reduced in diameter and is formed into a rod shape (cylindrical shape) as a whole, and its leading end face is formed flat. The aforementioned cylindrical noble metal tip 31 is superposed thereon, and the noble metal tip 31 and the center electrode 5 are joined as laser welding, electron beam welding, resistance welding, or the like is performed along an outer peripheral edge portion of its joint surface. Meanwhile, the noble metal tip 32 opposed thereto is positioned at a predetermined position on the ground electrode 27, and is joined as welding is performed along an outer peripheral edge portion of its joint surface. It should be noted that either one (or both) of the noble metal tip 31 and the noble metal tip 32 opposed thereto may be omitted in the configuration. In this case, the spark discharge gap 33 is formed between the noble metal tip 32 and a main body portion of the center electrode 5 or between the noble metal tip 31 and a main body portion of the ground electrode 27, which are opposed to each other, respectively.

Figure 2:
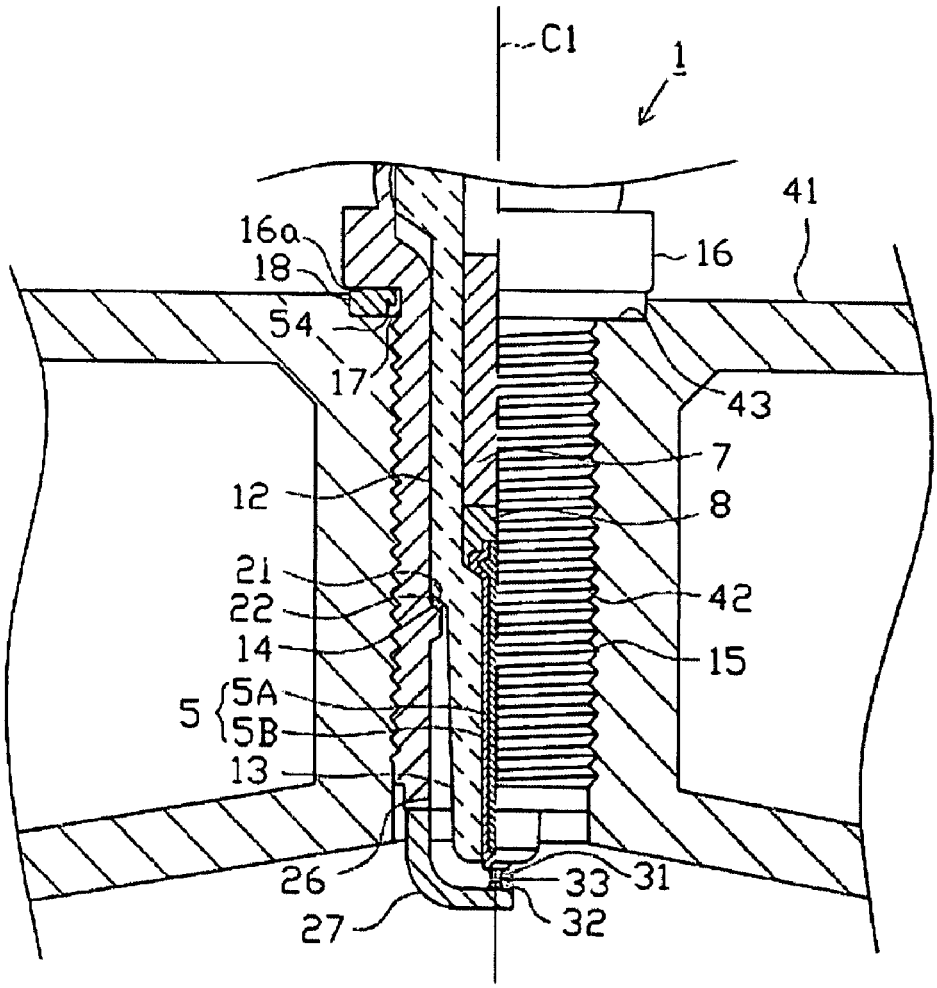
FIG. 2 is a partial cross-sectional view illustrating a mounted state of the spark plug.

Here, a detailed description will be given if the gasket 18 which is a characteristic portion of this embodiment. As shown in FIG. 2, the spark plug 1 is installed in a threaded hole 42 of the cylinder head 41 of the engine by threadedly securing the aforementioned externally threaded portion 15 therein. In conjunction with the threaded securing, i.e., screwing in, the gasket 18 is arranged to be compressed in such a manner as to be crushed between the gasket receiving portion 16*a* and a peripheral edge portion 43 of the opening of the threaded hole 42, thereby sealing the gap between the threaded hole 42 and the gasket receiving portion 16*a*.

Figure 3A:
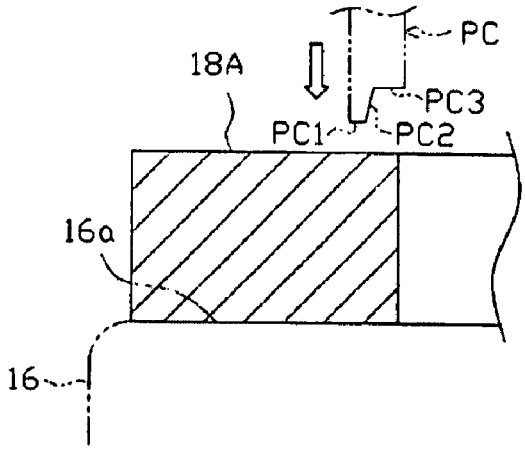
FIG. 3A is a partial cross-sectional view illustrating a preform of a gasket.
Figure 3B:
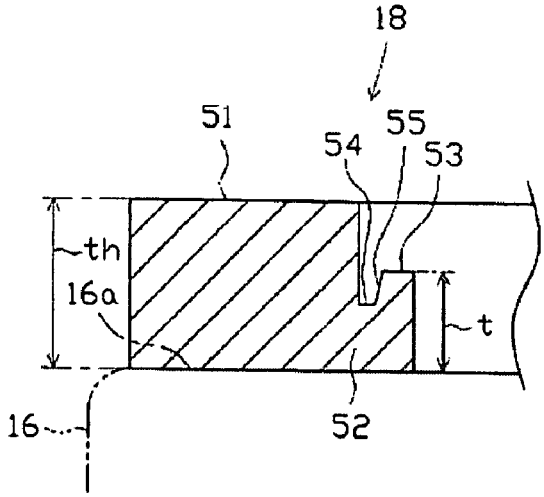
FIG. 3B is a partial cross-sectional view illustrating the gasket.

As shown in FIG. 3B, the gasket 18 in this embodiment has a solid annular shape. More specifically, the gasket 18 is formed of a copper alloy and includes a main body portion 51 serving as an outer peripheral side portion as well as an annular pawl portion 53 serving as an inner peripheral side portion extending radially inwardly of the main body portion 51 through a constricted portion 52. In addition, an annular groove portion 54 which is open on the leading end side (on the upper side in FIG. 3B and on the lower side in FIG. 2) is formed at a portion corresponding to the constricted portion 52. An inside diameter A of the gasket 18 is formed to be smaller than an outside diameter D (see FIG. 4A) of the externally threaded portion 15, thereby providing a measure for preventing the gasket 18 from riding over the thread. In addition, the wall surface on the inner peripheral side of the annular groove portion 54 is formed as a tapered surface 55.

Further, the width (the length in the left-right direction in FIG. 3B) of the main body portion 51 is set to be not less than the width of the annular pawl portion 53. In addition, the thickness th of the main body portion 51 is set to be greater than the thickness t in the direction of the axis C1 of the annular pawl portion 53. However, in this embodiment, the thickness t in the direction of the axis C1 of the annular pawl portion 53 satisfies the following formula (1).

$$t \geq \frac{\sqrt{3}}{2} \times \frac{P}{2H}(A + H - Dp) \times \frac{1}{\sin(60° - \theta)} \tag{1}$$

where A is the inside diameter of the gasket;

P is the pitch of the thread;

Dp is the effective diameter of the thread;

H is a horizontal distance between an imaginary point at a trough of the thread and an imaginary point at a ridge of the thread; and θ is an angle (lead angle) formed by the axis and an inner end line of the gasket in an arbitrary cross section along the axis when it is assumed that an inner end of the gasket slides along the externally threaded portion.

Figure 4A:
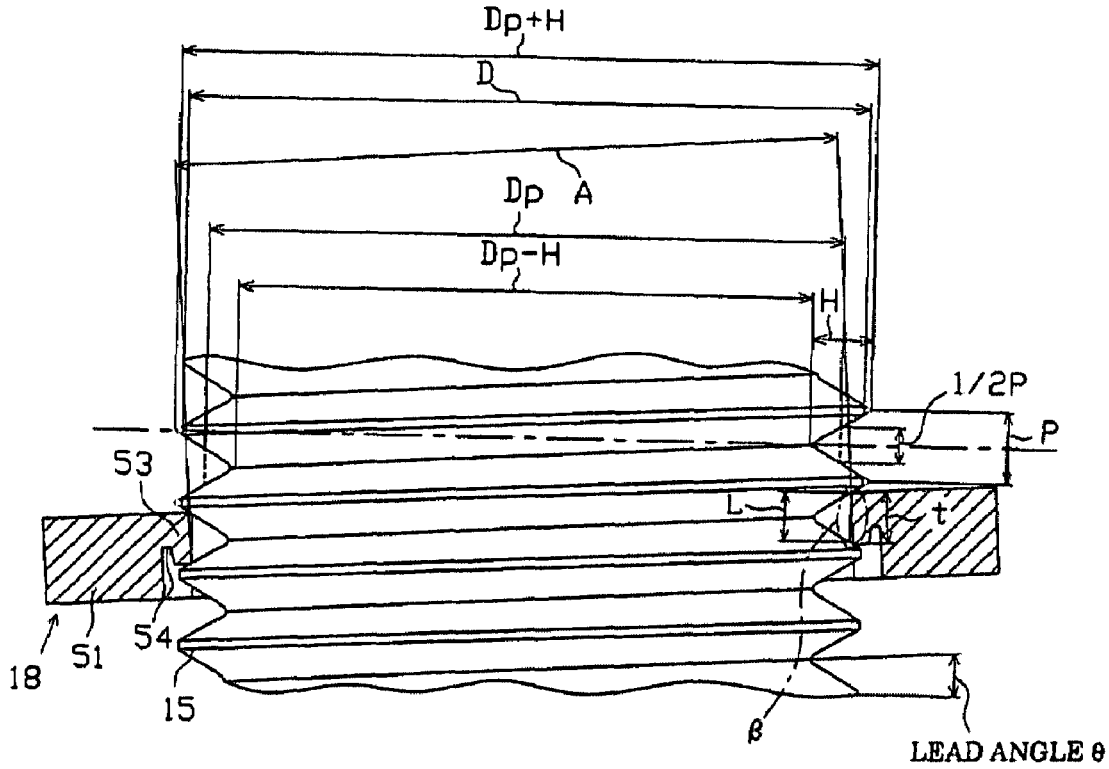
FIG. 4A is a conceptual diagram for explaining such as the thickness in the axial direction of an annular pawl portion.
Figure 4B:
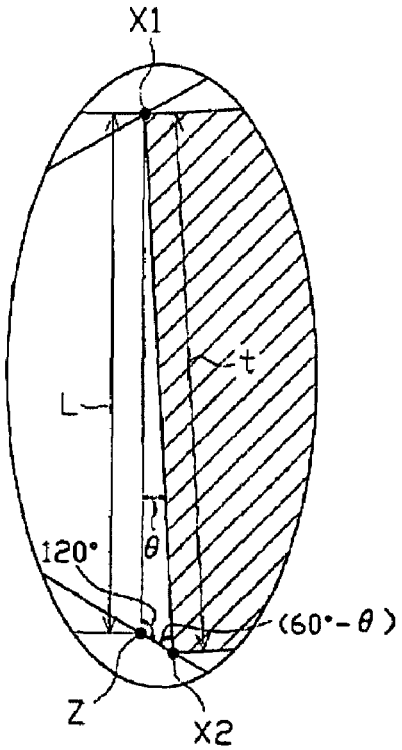
FIG. 4B is an enlarged portion a β portion.

Here, a description will be given of the above-described formula (1). As shown in FIGS. 4A and 4B, in a case where the thickness t in the direction of the axis C1 of the annular pawl portion 53 is excessively small, i.e., the annular pawl portion 53 is thin-walled, even if the inside diameter A of the gasket 18 is smaller than the outside diameter D of the externally threaded portion 15, there are cases where the inner end of the thin-walled annular pawl portion 53 undesirably enters the trough of the externally threaded portion 15. In this case, it is apprehended that the gasket 18 may relatively rotate along the trough and may undesirably come off finally. For example, cases are envisioned in which, as shown in FIG. 4A, the inner end of the annular pawl portion 53 undesirably enters the trough of the externally threaded portion 15 and slides along the externally threaded portion 15. It can be said that, in order to avoid such a situation, it is sufficient if the thickness t in the direction of the axis C1 of the annular pawl portion 53 is large enough to such an extent as not to fall into the thread trough.

Accordingly, if an assumption is made of the state shown in the drawing, i.e., the case in which the inner end of the annular pawl portion 53 enters the trough of the externally threaded portion 15 and slides along the externally threaded portion 15, the following formula (2) holds.

$$P:L=H:[A-(Dp-H)]/2 \tag{2}$$

where L is a vertical distance (distance between points X1 and Z) from the innermost end point X1 (see FIG. 4B which is an enlarged view illustrating a β portion in FIG. 4A) to an opposing thread edge when it is assumed that the inner end (two inner end points X1 and X2) of the gasket 18 slides along the externally threaded portion 15 (in a state of abutment against the thread edge).

From the above-described formula (2), the following formula (3) holds.

$$L=P(A+H-Dp)/2H \tag{3}$$

Meanwhile, if attention is focused on a triangle X1X2Z shown in FIG. 4B, from a sine theorem the following formula (4) holds.

$$\frac{t1}{\sin 120^\circ} = \frac{L}{\sin(60^\circ - \theta)} \tag{4}$$

where t1 is a maximum thickness of the annular pawl portion 53 in the direction of the axis C1 in the case in which the inner end of the annular pawl portion 53 enters the trough of the externally threaded portion 15 and slides along the externally threaded portion 15.

From the above-described formula (4), the following formula (5) holds.

$$t1 \geq \frac{\sqrt{3}}{2} \times \frac{L}{\sin(60^\circ - \theta)} \tag{5}$$

If L in the above-described L is substituted into L in the above-described formula (5), the following formula (6) holds.

$$t1 \geq \frac{\sqrt{3}}{2} \times \frac{P}{2H}(A + H - Dp) \times \frac{1}{\sin(60^\circ - \theta)} \tag{6}$$

Therefore, it can be said that if the thickness t in the direction of the axis C1 of the annular pawl portion 53 satisfies the above-described formula (1), the annular pawl portion 53 does not enter the thread trough.

Figure 5A:
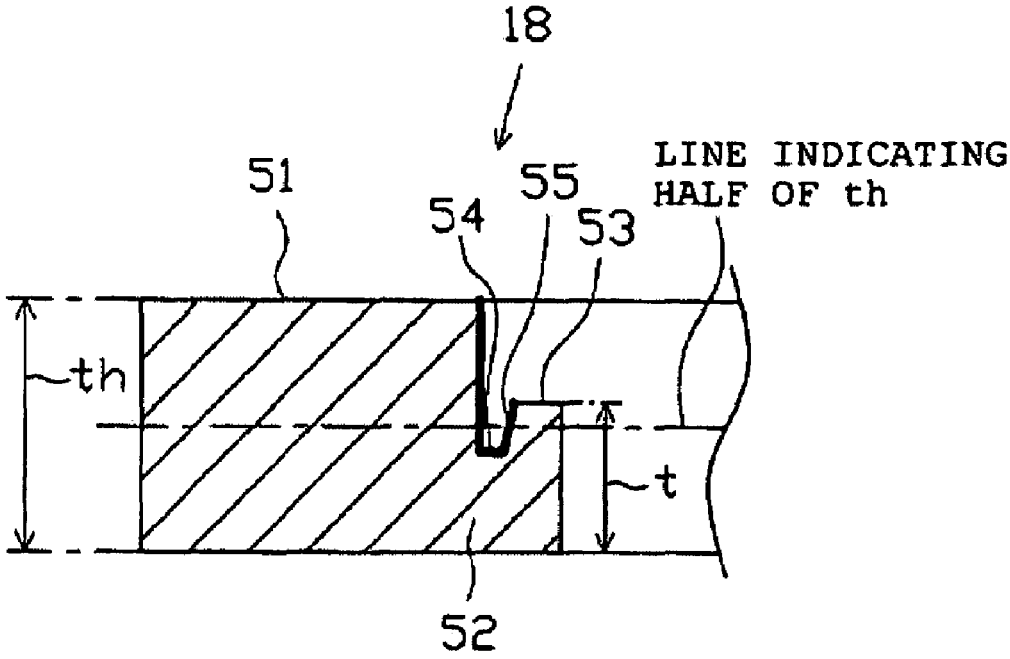
FIGS. 5A and 5B are partial cross-sectional views illustrating the configuration of the gasket.
Figure 5B:
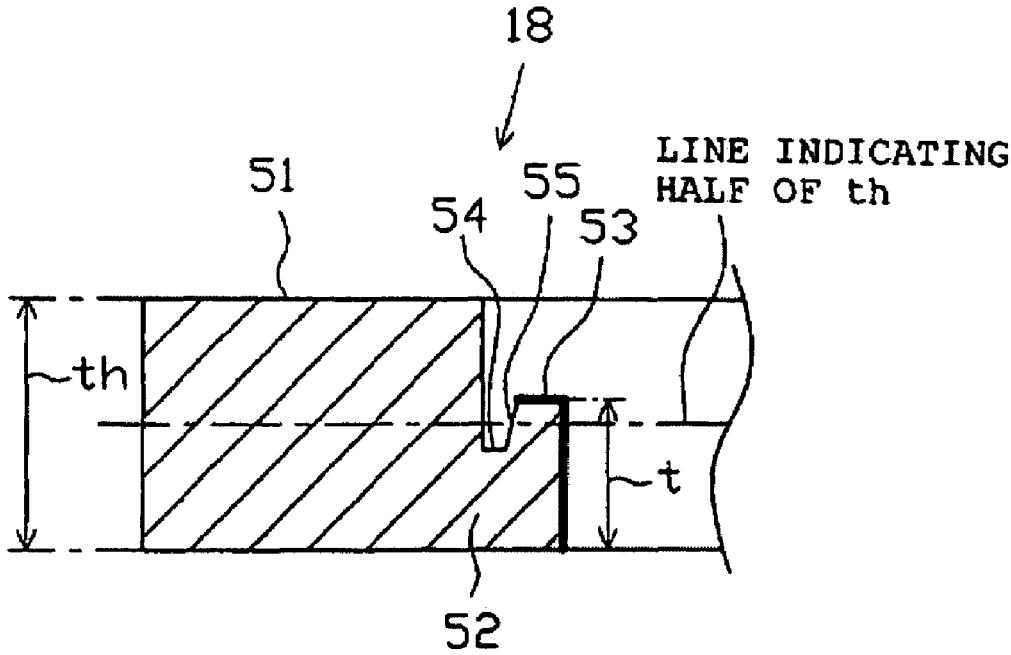

Furthermore, in this embodiment, the annular groove portion 54 is formed deeply in excess of a half of the thickness th of the aforementioned main body portion 51 (see the solid line in FIG. 5A). On the other hand, the thickness t in the direction of the axis C1 of the annular pawl portion 53 is formed with a large thickness in excess of a half of the thickness th of the main body portion 51 (see the solid line in FIG. 5B).

Next, a description will be given of the method of manufacturing the spark plug 1 configured as described above. First, the metal shell 3 is processed in advance. Namely, a cylindrical metallic material (an iron-based material or a stainless steel material such as S17C or S25C) is subjected to cold forging to thereby form a through hole, thereby creating a rough form. Then, the rough form is subjected to cutting to arrange an outer shape, thereby obtaining an intermediate body of the metal shell.

Subsequently, the ground electrode 27 formed of an Ni-based alloy (e.g., an Inconel-based alloy or the like) is resistance welded to a leading end face of the intermediate body of the metal shell. So-called sagging occurs in the welding, so that after the sagging is eliminated, the externally threaded portion 15 is formed at a predetermined portion of the intermediate body of the metal shell by rolling. As a result, the metal shell 3 with the ground electrode 27 welded thereto is obtained. The metal shell 3 with the ground electrode 27 welded thereto is subjected to zinc plating or nickel plating. It should be noted that, to attain improvement of corrosion resistance, its surface may be further provided with chromate treatment.

Furthermore, the aforementioned noble metal tip 32 is joined to the leading end portion of the ground electrode 27 by such as resistance welding or laser welding. It should be noted that, to render the welding more reliable, the removal of the plating at the welded portion is performed prior to the welding, or masking is provided for a presumptive portion of welding at the time of the plating process. In addition, the welding of the noble metal tip 32 may be performed after the assembly which will be described later.

Meanwhile, the insulator 2 is fabricated in advance separately from the above-described metal shell 3. For example, green granules for molding are prepared by using a raw material powder consisting mainly of alumina and including a binder and the like, and a cylindrical compact is obtained by performing rubber press molding by using them. The compact thus obtained is subjected to grinding and is thereby shaped. The shaped piece is charged into a furnace and is sintered. After the sintering, various grinding is provided to thereby obtain the insulator 2.

In addition, the center electrode 5 is fabricated in advance separately from the metal shell 3 and the insulator 2 mentioned above. Namely, an Ni-based alloy is subjected to forging, and the inner layer 5A consisting of a copper alloy provided in its central portion so as to improve radiation performance. Further, the aforementioned noble metal tip 31 is joined to its leading end portion by such as resistance welding or laser welding.

Then, the insulator 2 and the center electrode 5 obtained as described above, as well as the resistor 7 and the terminal electrode 6, are sealed and fixed by the glass seal layers 8 and 9. The glass seal layers 8 and 9 are generally prepared by mixing borosilicate glass and a metal powder. After the prepared mixture is charged into the axial hole 4 of the insulator 2 in such a manner as to sandwich the resistor 7, and the terminal electrode 6 is set in a state of being pressed from the rear, the prepared mixture is baked and hardened in the baking furnace. It should be noted that, at this time, a glazing layer may be simultaneously baked on the surface of the trunk portion on the rear end side, or a glazing layer may be formed thereon beforehand.

Subsequently, the metal shell 3 having the ground electrode 27, as well as the insulator 2 having the center electrode 5 and the terminal electrode 6, which have been respectively prepared as described above, are assembled. More specifically, the metal shell 3 is fixed to the insulator 2 by radially inwardly caulking the opening portion on the rear end side of the metal shell 3 which is formed with a relatively thin wall thickness, i.e., by forming the aforementioned caulking portion 20.

Then, by bending the ground electrode 27, working is carried out for adjusting the aforementioned spark discharge gap 33 between the noble metal tip 31 provided at the leading end of the center electrode 5 and the noble metal tip 32 provided at the ground electrode 27.

Finally, a preform 18A of the gasket 18 is fitted over the thread neck 17 past the externally threaded portion 15. This preform 18A, when fitted, has an annular shape with a rectangular cross section, as shown in FIG. 3A. In addition, the inside diameter of the preform 18A is set to be greater than the outside diameter of the externally threaded portion 15 of the metal shell 3. Further, the preform 18A in a state of being supported by the gasket receiving portion 16*a* is pressed by a predetermined working jig PC (hereafter simply referred to as the "jig PC") having an annular shape indicated by the two-dot chain line in FIG. 3A. It should be noted that the jig PC has on its outer peripheral side a protruding portion PC1 for forming an annular groove portion, which protrudes in the pressing direction (downward in the drawing), and has on the inner peripheral side of that protruding portion PC1 a receiving surface PC3 for receiving the annular pawl portion 53 through a tapered surface PC2 which is tapered in the direction opposite to the pressing direction. Then, as the annular jig PC is thus pressed, the aforementioned annular groove 54 is formed. At this time, as the pressed wall portion juts out toward the inner peripheral side, the annular pawl portion 53 is formed. As a result, the inside diameter A of the gasket 18 is made smaller than the outside diameter D of the externally threaded portion 15, thereby preventing the gasket 18 from coming off. It should be noted that since the aforementioned jig PC is provided with the tapered surface PC2, as described above, the inner peripheral side wall surface of the annular groove portion 54 is consequently formed as the tapered surface 55. In addition, by virtue of the presence of the tapered surface PC2 of the jig PC, the thickness t of the annular pawl portion 53 formed in such a manner as to jut out toward the inner peripheral side by being pressed in does not become excessively small in accompaniment with the deformation of the annular groove portion 54. Hence, it is possible to attain the miniaturization of the inside diameter of the gasket 18.

Then, the spark plug 1 with the gasket 18 mounted thereto is manufactured after undergoing the above-described series of processes.

As described above in detail, according to this embodiment, since the gasket 18 has a solid annular shape, as compared with a gasket having a so-so-speak hollow shape such as a substantially S-shaped cross section or the like, it is possible to reduce the amount of crushing deformation at the time of threaded securing and suppress the variation of the amount of deformation as well. As a result, the variation of the ignition point in the installed state of the spark plug 1 is difficult to occur, so that it is possible to ensure a stable form of combustion.

In addition, as described above, as for the gasket 18, after its preform 18A is fitted, the preform 18A is pressed by using the predetermined jig PC to thereby form the annular groove portion 54, and as the pressed wall portion juts out toward the inner peripheral side, the annular pawl portion 53 is formed. Accordingly, unlike a gasket having a plurality of local pawl portions, the local recesses are not formed in the gasket 18 in this embodiment. For this reason, the situation in which the gas otherwise leaks through the local recesses does not occur, and therefore it is possible to prevent the defect of trouble undesirably occurring in the gas-tightness.

In addition, since the pawl portion is not localized, the crushing deformation is unlikely to occur at the time of threaded securing. For this reason, it is unlikely to occur for the inner peripheral portion of the gasket 18 to become relatively thin-walled after completion of the threaded securing, and the situation in which the inner peripheral portion enters the trough of the externally threaded portion and the gasket relatively rotates can be made difficult to occur.

Furthermore, as for the gasket 18, the thickness th of its main body portion 51 is set to be greater than the thickness t in the direction of the axis C1 of the annular pawl portion 53. For this reason, in the threadedly securing process of the spark plug 1, the main body portion 51 receives a compressive stress more preferentially, and the amount of crushing deformation of the gasket 18 during threaded securing is mainly determined on the basis of that main body portion 51. Here, since the main body portion 51 also has a solid shape, it is possible to minimize the variation of the thickness of the main body portion 51 in individual gaskets 18, so that the variation of the ignition point in the installed state of the spark plug 1 can be suppressed relatively easily. On the other hand, it can be said that the annular pawl portion 53 on the inner peripheral side of the annular groove portion 54 is difficult to be compressed during the threaded securing. For this reason, it is possible to prevent the tendency of the inner peripheral portion of the gasket 18 becoming thin-walled and, hence, the trouble caused by the thin wall due to the crushing deformation during the threaded securing.

In particular, in this embodiment, the thickness t in the direction of the axis C1 of the annular pawl portion 53 satisfies the above-described formula (1). Namely, since the thickness t is sufficiently large, the situation in which the annular pawl portion 53 undesirably enters the trough of the externally threaded portion 15 does not occur. Consequently, the disengagement of the gasket 18 can be prevented more reliably.

Here, a verification experiment was conducted concerning whether or not gaskets in accordance with an example satisfied the above-described formula (1), so that the results of the verification are described below. Here, spark plugs of M12S×1.25 were used (in this case, reference was had to JIS B 0207 as the thread size; $P=1.25$, $D=12.000$, $H=P/(2\tan 30°)=1.083$, $Dp=11.188$, $\theta=2.92$). Meanwhile, as the performer of the gasket, an annular performer formed of a copper alloy and having an inside diameter of 12.01 mm and a thickness of 1.5 mm was used. Then, annular cut bending was performed by using the above-described jig PC. After the annular cut bending, the inside diameter A of the gasket was 11.45 mm (an average value of n=20), and the thickness t of the annular pawl portion was 1.14 mm (an average value of n=20). The maximum thickness t1 in the direction of the axis in the case in which the inner end of the annular pawl portion enters the trough of the externally threaded portion and slides along the externally threaded portion was such that t1≈0.801 mm. In contrast, in this example, t=1.14 mm>t1 (=0.801 mm). Accordingly, it can be said that this example satisfies the above-described formula (1). Of course, this example also satisfies A (=11.45 mm)<D (12.000 mm).

Figure 7:
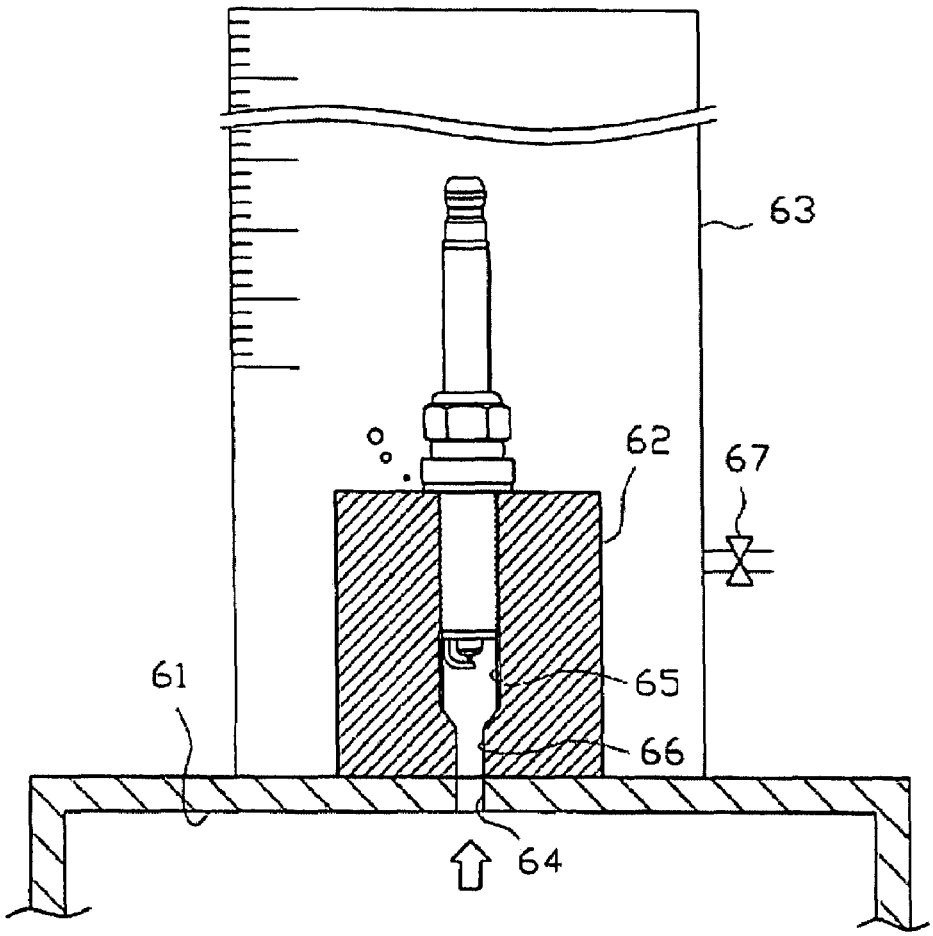
FIG. 7 is an explanatory diagram schematically illustrating a method of measuring the amount of air leakage in each sample.

Next, to confirm the operational effect concerning the above-described gas leakage prevention, various samples were fabricated, and evaluations were attempted. The experimental results are described below. First, a plurality of (four) spark plugs were prepared (samples 1 to 4) in each of which a solid gasket having an annular disk shape and corresponding to the conventional art was fitted over the thread neck of the metal shell, and three pawl portions were formed in such a manner as to project radially inward by cut bending after the fitting of the gasket. In addition, the plurality of (four) spark plugs 1 were prepared (samples 5 to 8) in each of which the gasket 18 having the annular pawl portion 53 and corresponding to this embodiment was mounted. Further, a plurality of (four) spark plugs were prepared (samples 9 to 12) in each of which a gasket having a hollow shape with a substantially S-shaped cross section and corresponding to the conventional art was fitted over the thread neck of the metal shell, and three pawl portions were formed in such a manner as to project radially inward by cut bending after the fitting of the gasket. Then, as shown in FIG. 7, an air chamber 61, an aluminum bushing 62, a leaked air measurement case 63 were prepared, and an air leakage test was conducted by using them. More specifically, compressed air was capable of being introduced into the air chamber 61 through an unillustrated solenoid valve, and a supply port 64 was provided. The aluminum bushing 62 having a threaded hole 65 and air supply passage 66 formed therein was fixed in correspondence with this supply port 64, and the respective samples 1 to 12 were mounted in the threaded hole 65. However, the tightening torque at this time was fixed at 20 N·m for all the samples. In addition, the leaked air measurement case 63 was fixed in such a manner as to envelop each sample (spark plug) and the aluminum bushing 62. This leaked air measurement case 63 had on its side surface graduations as in a measuring cylinder, and its interior was filled with a liquid (e.g., ethanol). The arrangement provided was such that the level of the liquid changed due to the leaked air, making it possible to measure the amount of leaked air. In addition, as shown in the drawing, a solenoid valve 67 may be provided in this leaked air measurement case 63 so that the liquid or air to be filled in its interior can be arbitrarily transferred to or from it. Under such a configuration, predetermined air pressure (1.5 Mpa) was applied to the interior of the air chamber 61, and the amount of air leakage per unit time (1 minute) from between the gasket and the opening of the threaded hole 65 of the aluminum bushing 62 was measured through the supply port 64 and the air supply passage 66.

Figure 6:
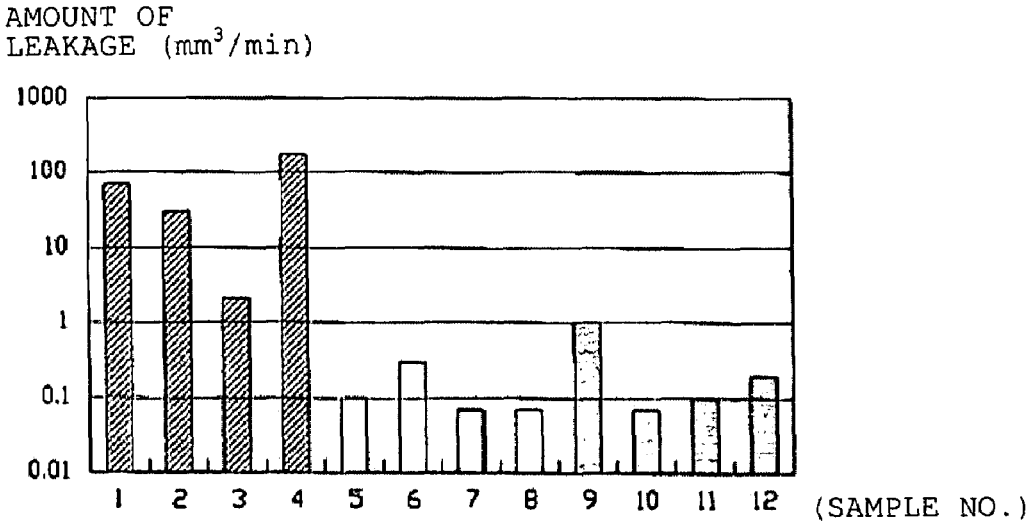
FIG. 6 is a graph illustrating the relationship of the amount of air leakage for each sample.

The results are shown in FIG. 6. As shown in the drawing, even in the case of the solid gaskets having the annular disk shape, in the case where the plurality of pawl portions were projectingly formed locally (samples 1 to 4), the gas-tightness performance deteriorated appreciably. In contrast, in the case of this embodiment (samples 5 to 8), the air-tightness equivalent to that in the case of the gaskets having the hollow shape with the substantially S-shaped cross section (samples 9 to 12) was obtained. As a result, in the gasket 18 in accordance with this embodiment, local recesses as in those of the samples 1 to 4 are not formed, and it can be said that the situation in which gas otherwise leaks through the local recesses can be prevented.

It should be noted that the invention is not limited to the details of the above-described embodiment, and may, for example, be carried out as follows.

(a) In the above-described embodiment, finally after the manufacturing process of the spark plug 1, the preform 18A of the gasket 18 is fitted over the thread neck 17 past the externally threaded portion 15. In contrast, for example, in a preliminary step of working for adjusting the spark discharge gap 33, the preform 18A may be fitted and the formation of the annular pawl portion 53 may be provided.

(b) The cross-sectional shape of the gasket 18 in the above-described embodiment is, in a strict sense, a typical example. Accordingly, it is utterly permissible even if a slight bulged portion or a slightly rounded portion is formed in conjunction with the pressing of the jig PC. In addition, FIGS. 3A and 3B schematically illustrate the concept of the invention, and it is unnecessary for the cross-sectional shape of an actual gasket to be depicted with straight lines.

(c) In addition, the material of the gasket 18 is not limited to a copper alloy, and copper, zinc, aluminum, iron, or an alloy thereof, or the like may be used.

(d) In the above-described embodiment, an embodiment is given of the case in which the ground electrode 27 is joined to the leading end of the metal shell 3, the invention is also applicable to a case in which the ground electrode is formed in such a manner as to cut out a portion of the metal shell (or a portion of a metal tip welded in advance to the metal shell (e.g., JP-A-2006-236906 and the like).

(e) Although in the above-described embodiment the inner peripheral side wall surface of the annular groove portion 54 is formed as the tapered surface 55, the invention is also applicable to a case in which the tapered surface is not formed.

This application is based on Japanese Patent application JP 2006-293425, filed Oct. 30, 2006, and Japanese Patent application JP 2007-246490, filed Sep. 25, 2007, the entire contents of which are hereby incorporated by reference, the same as if fully set forth herein.

Although the invention has been described above in relation to preferred embodiments and modifications thereof, it will be understood by those skilled in the art that other variations and modifications can be effected in these preferred embodiments without departing from the scope and spirit of the invention.

What is claimed is:

1. A spark plug for an internal combustion engine comprising:

a cylindrical insulator having an axial hole penetrating in a direction of an axis;

a center electrode insertedly provided in the axial hole;

a cylindrical metal shell provided on an outer periphery of the insulator and having, on an outer periphery of the metal shell, an externally threaded portion for mounting; and a ground electrode provided on the metal shell such that a portion of the ground electrode opposes a leading end portion of the center electrode, in which a spark discharge gap is provided between the ground electrode and the leading end portion of the center electrode, an annular gasket receiving portion projecting radially outward being provided on a rear end side of the externally threaded portion of the metal shell, and a metallic gasket capable of abutting against the gasket receiving portion being provided on the outer periphery of the metal shell, wherein the gasket has a solid annular shape, an inside diameter of the gasket is smaller than an outside diameter of the externally threaded portion, and a groove portion whose depth coincides with the direction of the axis is provided over an entire circumference of the gasket, and wherein the gasket comprises an inner peripheral side portion on an inner peripheral side of the groove portion and an outer peripheral side portion on an outer peripheral side of the groove portion, and a thickness of the outer peripheral side portion in the direction of the axis is greater than a thickness of the inner peripheral side portion in the direction of the axis.

2. The spark plug for an internal combustion engine according to claim 1, wherein the groove portion is formed deeply in excess of a half of the thickness of the outer peripheral side portion in the direction of the axis, while the thickness of the inner peripheral side portion in the direction of the axis is formed with a large thickness in excess of a half of the thickness of the outer peripheral side portion in the direction of the axis.

3. The spark plug for an internal combustion engine according to claim 1, wherein a wall surface on the inner peripheral side of the groove portion is formed as a tapered surface.

4. The spark plug for an internal combustion engine according to claim 1, wherein when a thickness in the direction of the axis of an innermost peripheral side portion of the gasket is represented by t, a following formula (1) is satisfied;

$$t \geq \frac{\sqrt{3}}{2} \times \frac{P}{2H}(A + H - Dp) \times \frac{1}{\sin(60^\circ - \theta)} \quad (1)$$

where A is the inside diameter of the gasket;

P is a pitch of a thread;

Dp is an effective diameter of the thread;

H is a horizontal distance between an imaginary point at a trough of the thread and an imaginary point at a ridge of the thread; and θ is an angle formed by the axis and an inner end line of the gasket in an arbitrary cross section along the axis when it is assumed that an inner end of the gasket slides along the externally threaded portion.

5. A method for manufacturing the spark plug for an internal combustion engine according to claim 1, comprising:

forming a gasket preform having an annular shape and having an inside diameter greater than the outside diameter of the externally threaded portion of the metal shell; and by using a working jig having on the outer peripheral side a protruding portion for forming the groove portion, which protrudes in a pressing direction, and having on an inner peripheral side of the protruding portion a receiving surface for receiving a portion on an inner peripheral side of a portion where the groove portion is formed, through a tapered surface which is tapered in a direction opposite to the pressing direction, forming the gasket in which an inside diameter of an inner peripheral side portion on an inner peripheral side of the groove portion is smaller than the outside diameter of the externally threaded portion, on the basis of the pressing of the gasket preform.

* * * * *